US009186536B2

(12) United States Patent
Strachan

(10) Patent No.: US 9,186,536 B2
(45) Date of Patent: Nov. 17, 2015

(54) TRAINING DEVICE

(71) Applicant: Kenneth L. Strachan, Bowie, MD (US)

(72) Inventor: Kenneth L. Strachan, Bowie, MD (US)

( * ) Notice: Subject to any disclaimer, the term of this patent is extended or adjusted under 35 U.S.C. 154(b) by 0 days.

(21) Appl. No.: 14/108,849

(22) Filed: Dec. 17, 2013

(65) Prior Publication Data

US 2014/0171276 A1 Jun. 19, 2014

Related U.S. Application Data

(60) Provisional application No. 61/738,318, filed on Dec. 17, 2012.

(51) Int. Cl.

| | |
|---|---|
| ***A63B 21/02*** | (2006.01) |
| ***A63B 21/055*** | (2006.01) |
| ***A63B 21/00*** | (2006.01) |
| ***A63B 21/04*** | (2006.01) |
| ***A63B 23/035*** | (2006.01) |
| ***A63B 23/04*** | (2006.01) |

(52) U.S. Cl.

CPC ..... *A63B 21/0557* (2013.01); *A63B 21/00185* (2013.01); *A63B 21/0442* (2013.01); *A63B 21/0552* (2013.01); *A63B 21/143* (2013.01); *A63B 21/1419* (2013.01); *A63B 21/1449* (2013.01); *A63B 23/03541* (2013.01); *A63B 23/0405* (2013.01); *A63B 2209/10* (2013.01)

(58) Field of Classification Search

CPC ..... A63B 21/143; A63B 21/0557; A63B 21/055; A63B 21/0555; A63B 21/0552; A63B 23/0405; A63B 21/1449; A63B 21/0442; A63B 21/1419; A63B 21/00185; A63B 23/03541; A63B 2209/10

USPC ..... 482/79, 121–130, 139; 473/277

See application file for complete search history.

(56) References Cited

U.S. PATENT DOCUMENTS

| | | | | |
|---|---|---|---|---|
| 2,097,376 | A | 10/1937 | Marshman | |
| 3,411,500 | A * | 11/1968 | Gatts | 600/20 |
| 4,728,103 | A * | 3/1988 | Fulton | 482/125 |
| 4,910,802 | A * | 3/1990 | Malloy | 2/69 |
| 5,062,642 | A * | 11/1991 | Berry et al. | 473/277 |
| 5,203,754 | A | 4/1993 | Maclean | |
| 5,582,579 | A * | 12/1996 | Chism et al. | 601/27 |
| 5,688,213 | A * | 11/1997 | Recker | 482/125 |
| 5,813,955 | A * | 9/1998 | Gutkowski et al. | 482/124 |
| 6,428,495 | B1 * | 8/2002 | Lynott | 602/23 |
| 6,551,221 | B1 * | 4/2003 | Marco | 482/74 |
| 7,179,206 | B2 * | 2/2007 | Backes et al. | 482/80 |
| 7,744,511 | B2 * | 6/2010 | Grigoriev et al. | 482/124 |
| 7,998,041 | B1 * | 8/2011 | Johnson | 482/124 |
| 8,403,817 | B2 * | 3/2013 | Ferguson et al. | 482/79 |
| D694,414 | S * | 11/2013 | Sparkes | D24/190 |
| 8,915,827 | B2 * | 12/2014 | Cranke et al. | 482/121 |
| 2002/0068667 | A1 * | 6/2002 | Strachan | 482/124 |
| 2005/0043150 | A1 * | 2/2005 | Nitta et al. | 482/79 |
| 2005/0277527 | A1 * | 12/2005 | Gregerson | 482/124 |
| 2006/0063651 | A1 * | 3/2006 | Sload | 482/124 |
| 2013/0231227 | A1 * | 9/2013 | Ranieri | 482/124 |

* cited by examiner

*Primary Examiner* — Oren Ginsberg
*Assistant Examiner* — Joshua Lee
(74) *Attorney, Agent, or Firm* — Welsh Flaxman & Gitler LLC

(57) ABSTRACT

A training device includes a belt for attachment about the waist of a user. The belt includes a first end and a second end. The training device also includes a plurality of resilient straps positioned between the belt and a first foot engaging platform and a second foot engaging platform.

15 Claims, 8 Drawing Sheets

TRAINING DEVICE

CROSS REFERENCE TO RELATED APPLICATION

This application claims the benefit of U.S. Provisional Application Ser. No. 61/738,318, entitled "TRAINING DEVICE," filed Dec. 17, 2012.

BACKGROUND OF THE INVENTION

1. Field of the Invention

The invention relates to a training device. More particularly, the invention relates to a resilient training device adapted to strengthen the legs of a user while being worn by the user.

2. Description of the Related Art

Training devices for strengthening the legs of an individual have been around for some time. In fact, some of the prior training devices may be worn by the user while he or she exercises to strengthen his or her legs. For example, U.S. Pat. No. 2,097,376 to Marshman discloses an exerciser for attachment to the body of a user. The exerciser includes a harness for attachment to the upper body of the user. The harness supports a plurality of cables secured between the harness and the feet of the user.

Specifically, two cables are worn on the front of the harness and secured to the front of special shoes having eyes for attachment of the cables thereto. Two cables are also worn on the back of the harness and secured to the back of the special shoes having eyes for attachment of the cables thereto. Unfortunately, this design is rather cumbersome and does not provide a user with a wide range of flexibility as he or she uses the exerciser.

For example, the full upper body harness substantially confines the movements of the user, while the special shoes required by the exerciser make it difficult to adapt the exercise for different uses. In addition, the use of separate straps for the front and back of the exerciser substantially limits the versatility of the exerciser, since the fixed lengths of the cables do not adapt to the different positions a user might assume while he or she exercises.

Another training device employing elastic straps is disclosed in U.S. Pat. No. 5,062,642 to Berry et al. This training device includes a single strap secured between a belt and a pair of foot engaging loops to create two forward runs and two rearward runs. The device is primarily designed for training golfers to properly position their legs while swinging a golf club. As such, the foot engaging loops are shaped and designed for attachment at the arch of the user's feet.

While positioning each loop at the arch of a user's foot may be advantageous for golfers who remain stationary, the use of a foot engaging loop secured at each arch of a user's foot would cause a great deal of discomfort resulting from the application of pressure on the arch of the user's foot. In addition, the loop is not designed to remain on the foot of a user moving about while he or she exercises. Finally, the use of a single strap requires that the strap pass along the inner surface of the belt. While the attachment of the belt along the inner surface of the belt may be acceptable in golf training, where the golfer does not move a great deal, the belt mounted on the inner surface would apply undesirable pressure to the body of a user moving about while he or she exercises with the training device.

After reviewing the prior art, it is clear that a need exists for a training device that may be worn by a user to strengthen his or her core and legs while the user goes about his or her normal training routine. The present invention provides such a training device.

SUMMARY OF THE INVENTION

It is, therefore, an object of the present invention to provide a training device including a belt for attachment about the waist of a user, the belt including a first end and a second end, as well as a plurality of attachment loops secured on the belt adapted for positioning along a back of a user as he or she exercises and adapted for positioning along a front of a user as he or she exercises at various locations about a circumference of the belt. The training device includes a plurality of resilient straps selectively positioned between the plurality of attachment loops of the belt and a first foot engaging platform and a second foot engaging platform.

It is also an object of the present invention to provide a training device wherein the first end and the second end of the belt respectively include mating hook and loop material to facilitate secure attachment of the belt about the waist of the user.

It is another object of the present invention to provide a training device wherein adjustable connection straps respectively couple the plurality of attachment loops to the belt.

It is a further object of the present invention to provide a training device wherein the plurality of attachment loops includes four attachment loops secured on the belt and adapted for positioning along a back of a user as he or she exercises and four attachment loops secured to the belt and adapted for positioning along a front of a user as he or she exercises.

It is also an object of the present invention to provide a training device wherein the four attachment loops adapted for positioning along the back of the user are fixedly secured to the belt at a position between the first end of the belt and the second end of the belt.

It is another object of the present invention to provide a training device wherein the four attachment loops adapted for positioning along a front of a user as he or she exercises are secured to a support sleeve which is slid over the belt such that it is adapted for alignment with the front of an individual using the training device.

It is a further object of the present invention to provide a training device wherein the support sleeve includes an outer wall member connected to an inner wall member so as to define a passageway therebetween, the passageway being shaped and dimensioned to receive the belt, and wherein each of the four attachment loops adapted for positioning along a front of a user is coupled to the support sleeve by an adjustable connection strap extending from the support sleeve.

It is also an object of the present invention to provide a training device wherein the first foot engaging platform includes a long first support member extending along a first axis and a circular second support member extending along a second axis substantially perpendicular to the first axis.

It is another object of the present invention to provide a training device wherein the second support member is oriented at a position such that it is adapted to sit approximately at the forefoot of the user, and the second support member includes first and second eyelets on opposite first and second lateral sides of the second support member thereof allowing the second support member to be wrapped about the forefoot of the user, wherein the first and second eyelets are shaped and dimensioned for coupling to one of the plurality of resilient straps.

It is a further object of the present invention to provide a training device wherein the second support member bisects the first support member at a position dividing the first support member into a first segment above the second support member and a second segment below the second support member.

It is also an object of the present invention to provide a training device wherein the second segment is approximately 3 times the length of the first segment.

It is another object of the present invention to provide a training device wherein the first support member includes a first end and a second end, wherein the first end of the first support member is provided with a fastening member shaped and dimensioned for selective engagement with an end of one of the plurality of resilient straps.

It is a further object of the present invention to provide a training device wherein the second end of the first support member is provided with a fastening member shaped and dimensioned for selective engagement with an end of one of the plurality of resilient straps.

It is also an object of the present invention to provide a training device wherein the first foot engaging platform also includes a securing strap shaped and dimensioned to wrap about a forefoot of the user, the securing strap being attached the second support member and is oriented to extend parallel to the first support member.

It is another object of the present invention to provide a training device wherein the securing strap includes fasteners at its ends so that it may be wrapped and secured about the forefoot of the user.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
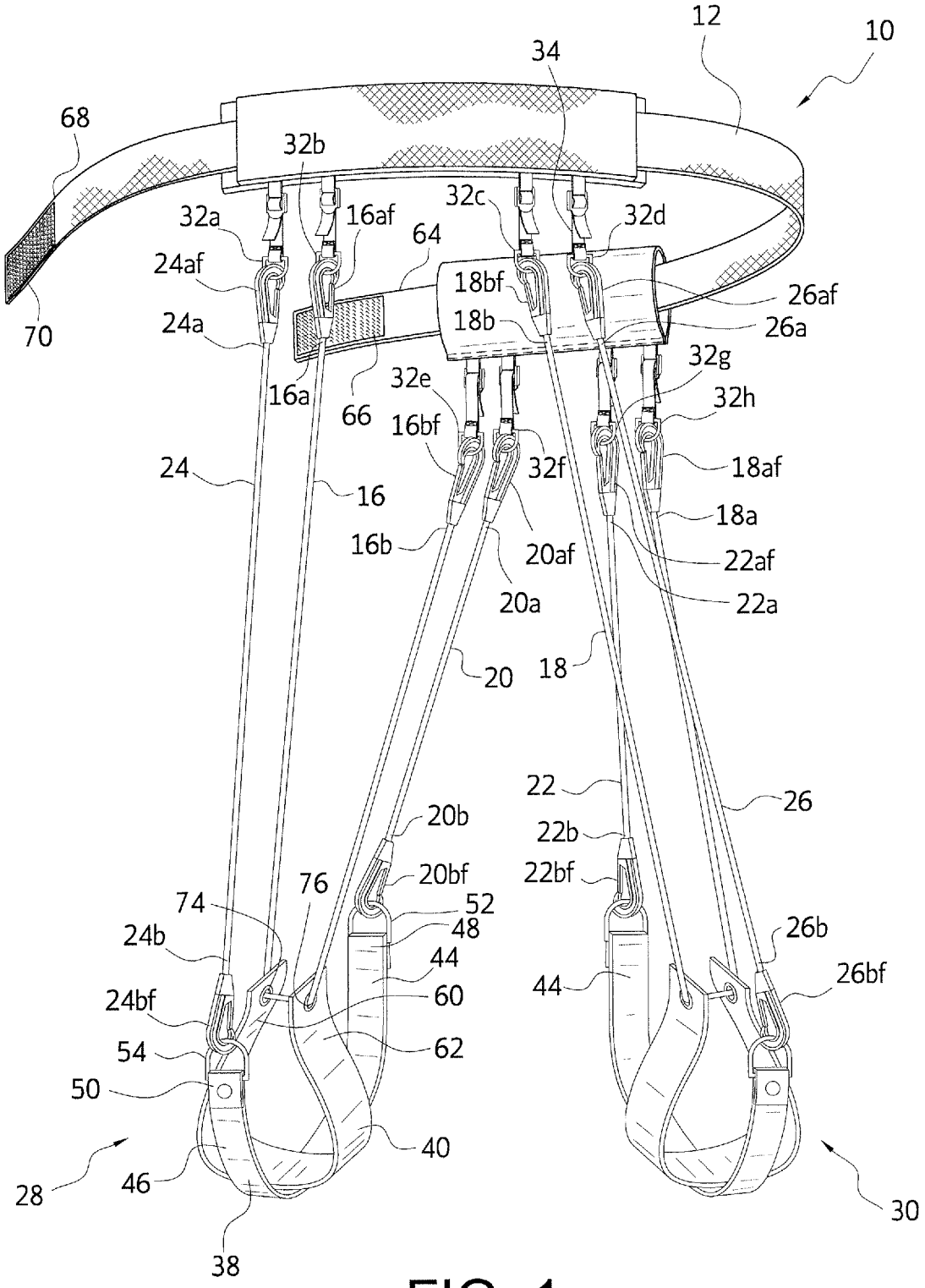
FIG. 1 is a perspective view of the present training device.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

With reference to the various figures, a training device 10 to strengthen the core and legs of a user is disclosed. The training device 10 is utilized while the training device 10 is worn by the user. The training device 10 includes a belt 12 adapted for attachment about the waist of a user. The belt 12 is similar to weight lifting belts used by an individual to support his or her back as he or she lifts weights. The belt 12 is, therefore, provided with Velcro (hook and loop material) material on its first and second ends 64, 68 to facilitate secure attachment of the belt 12 about the waist of the user. In accordance with a preferred embodiment of the present invention, the belt 12 includes a first end 64 that is provided with a length of hook type fastener material 66 and a second end 68 that is provided with a length of loop type fastener material 70. The hook type fastener material 66 and the loop type fastener material 70 are adapted for selective attachment in a manner well known to those skilled in the art. The use of the Velcro (hook and loop material) material allows for ready adjustment of the belt 12 to accommodate users of various sizes.

Strength training is provided by the provision of a plurality of resilient straps 16, 18, 20, 22, 24, 26 positioned between the belt 12 and the first foot engaging platform 28 and the second foot engaging platform 30 (which are respectively secured to the left and right feet of the user). As will be appreciated based upon the following disclosure, the resilient straps 16, 18, 20, 22, 24, 26 are selectively secured between the belt 12 and the first and second foot engaging platforms 28, 30 through the provision of fastening members on the ends of the resilient straps 16, 18, 20, 22, 24, 26, the first and second foot engaging platforms 28, 30 and the belt 12.

As for the belt 12, the belt 12 includes a plurality of attachment loops (or eyelets) 32*a-h* at various locations about the circumference of the belt 12. In accordance with a preferred embodiment, and with reference to FIGS. 1, 2, 3 and 4, each of the attachment loops 32*a-h* is coupled to the belt 12 with an adjustable connection strap 34. The connection strap 34 is adjustable in length through the provision of an adjustment buckle 36 allowing for adjustment of the length of the connection strap 34 and thereby adjustment of the distance between the attachment loop 32*a-h* secured thereto and the foot of a user. It is appreciated the attachment loops 32*a-h* will be metal loops so as to tolerate the force demands of the present invention.

In accordance with a preferred embodiment, four attachment loops 32*a-d* are secured on the belt 12 and adapted for positioning along the back of a user as he or she exercises. In addition, four attachment loops 32*e-h* are secured to the belt 12 and adapted for positioning along the front of a user as he or she exercises. With references to the four attachment loops 32*a-d* adapted for positioning along the back of the user, these attachment loops 32*a-d* are fixedly secured to the belt 12 at a position between the first end 64 of the belt 12 and the second end 68 of the belt 12. The attachment loops 32*a-d* are spaced along this length of the belt 12 so that interference between the resilient straps 16, 18, 20, 22, 24, 26 is avoided.

In addition, four attachment loops 32*e-h* are secured to the belt 12 for positioning along the front of a user as he or she exercises. The four attachment loops 32*e-h* extend from a support sleeve 72 as will be discussed below in greater detail. These four attachment loops 32*e-h* are adapted for positioning along the front of the user as he or she exercises, and these attachment loops 32*e-h* are fixedly secured to the support sleeve 72 which is slid over the belt 12 and positioned during use such that it is aligned with the front of an individual using the training device 10. The attachment loops 32*e-h* are spaced along this length of the belt 12 so that interference between the resilient straps 16, 18, 20, 22, 24, 26 is avoided.

Figure 2:
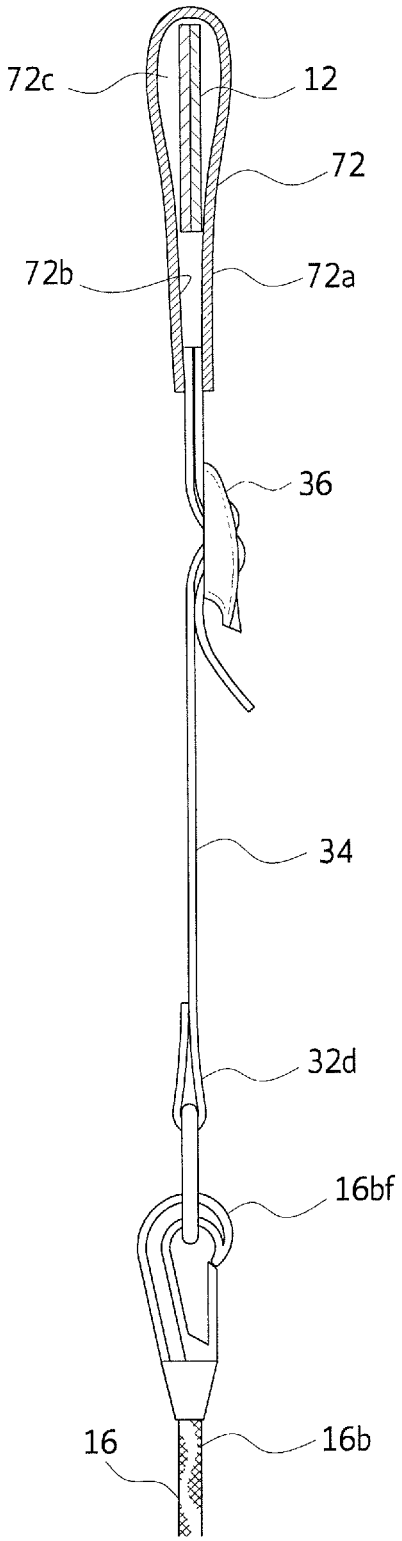
FIG. 2 is a detailed view of a connection strap extending from a belt.
Figure 3:
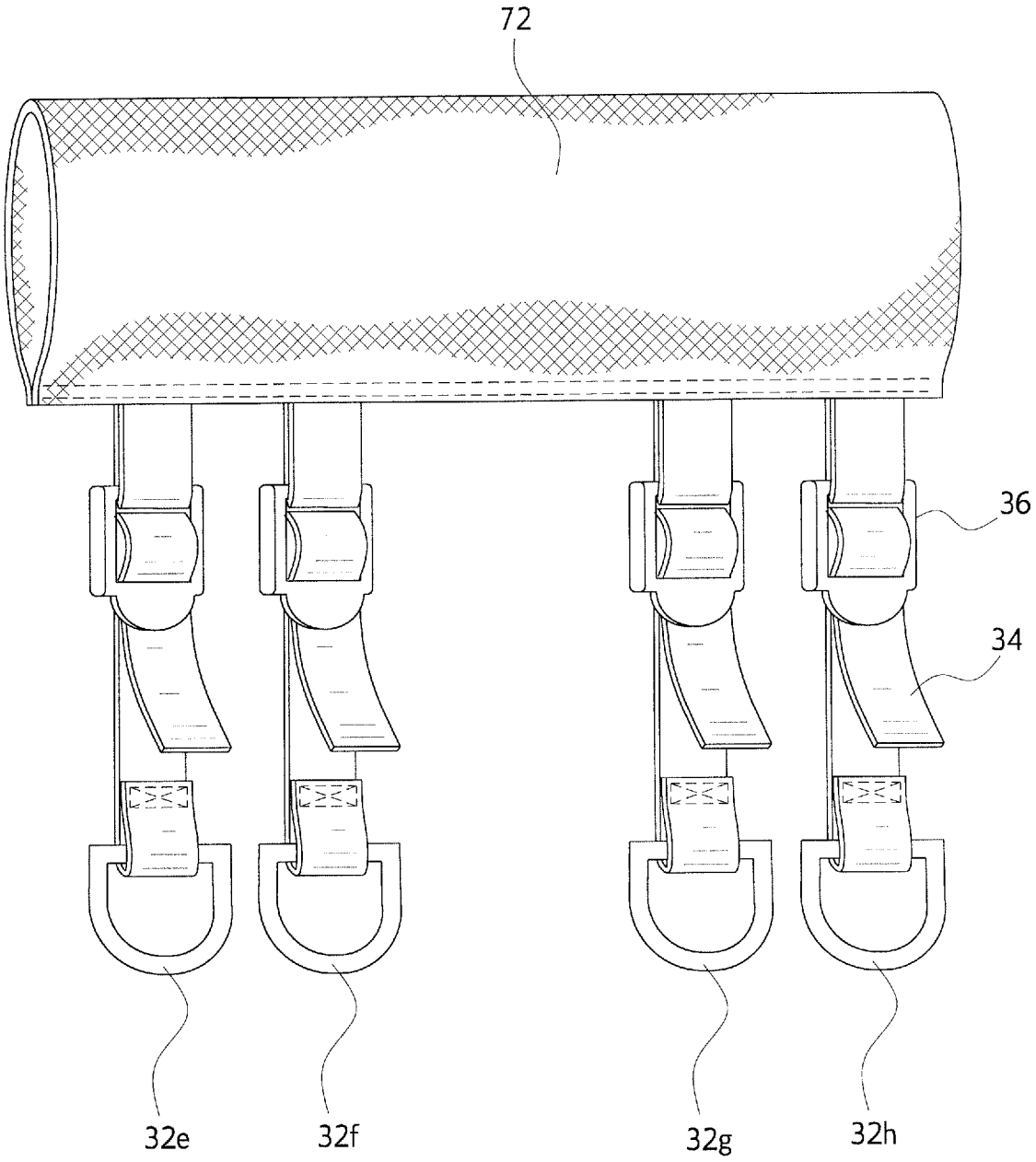
FIG. 3 is a side view of a second support sleeve from which a plurality of extension straps extend.
Figure 4:
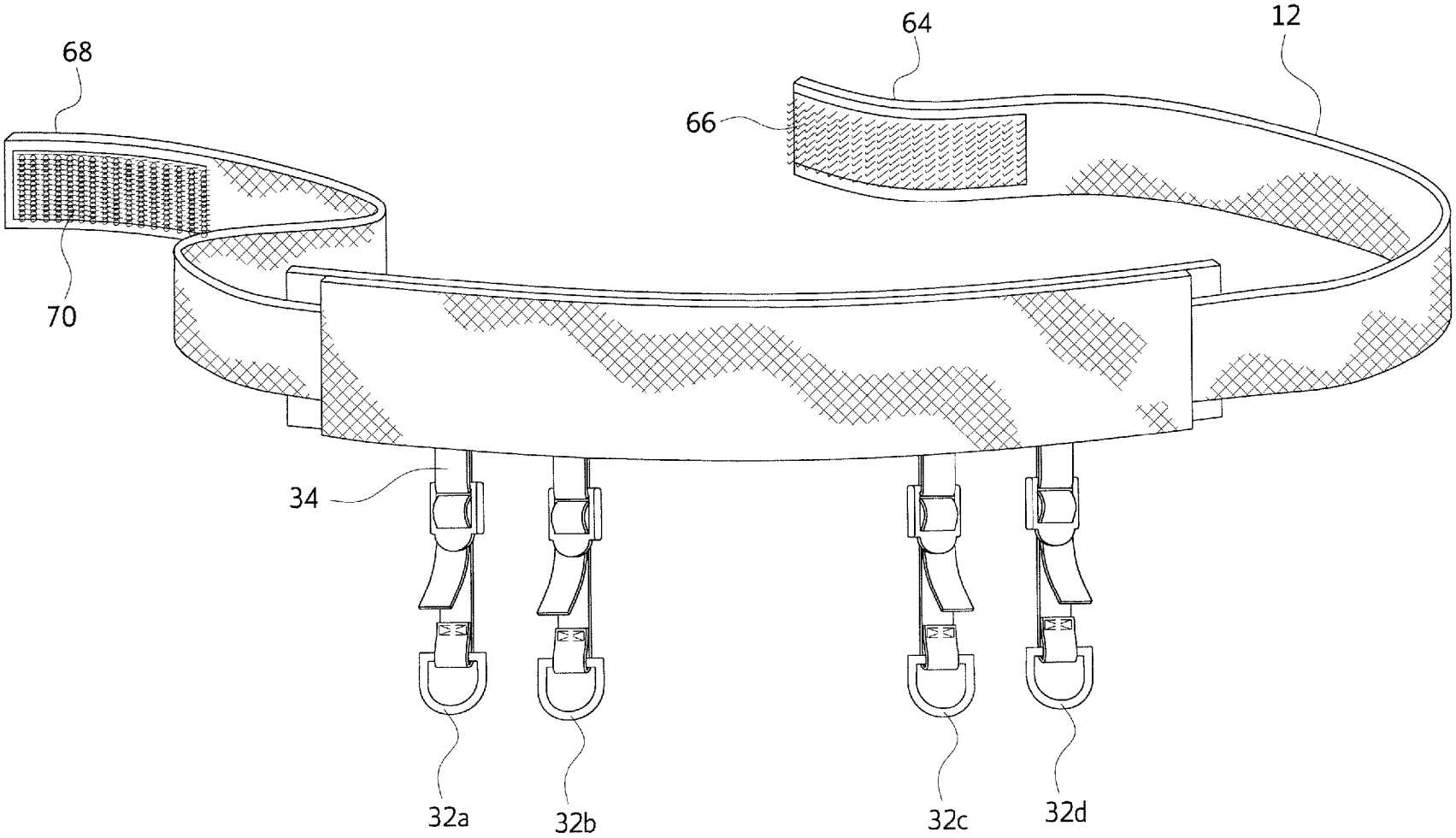
FIG. 4 is a perspective view of the belt.
Figure 5:
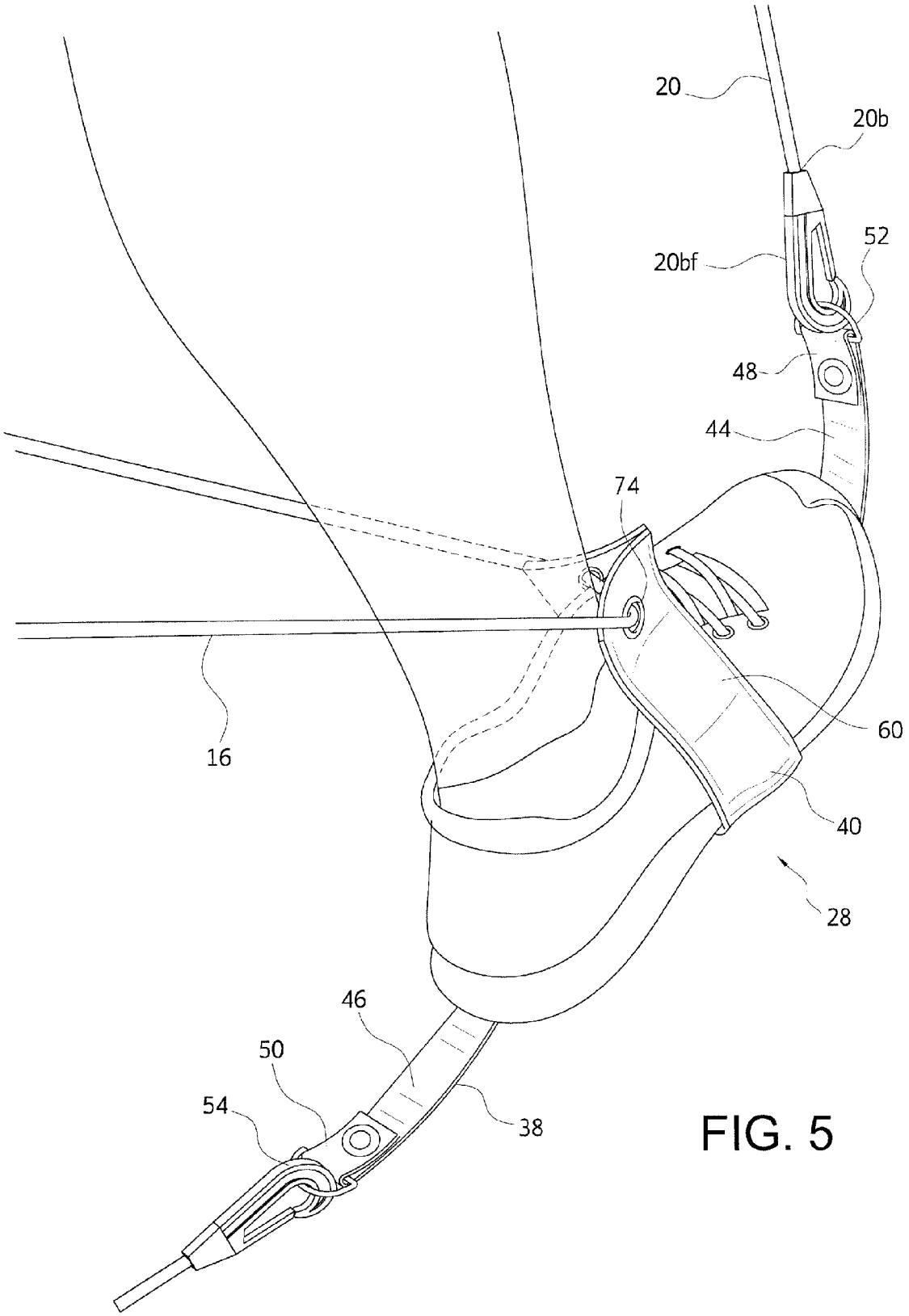
FIG. 5 is a detailed view of the first foot engaging platform secured to the right foot of a user.
Figure 6:
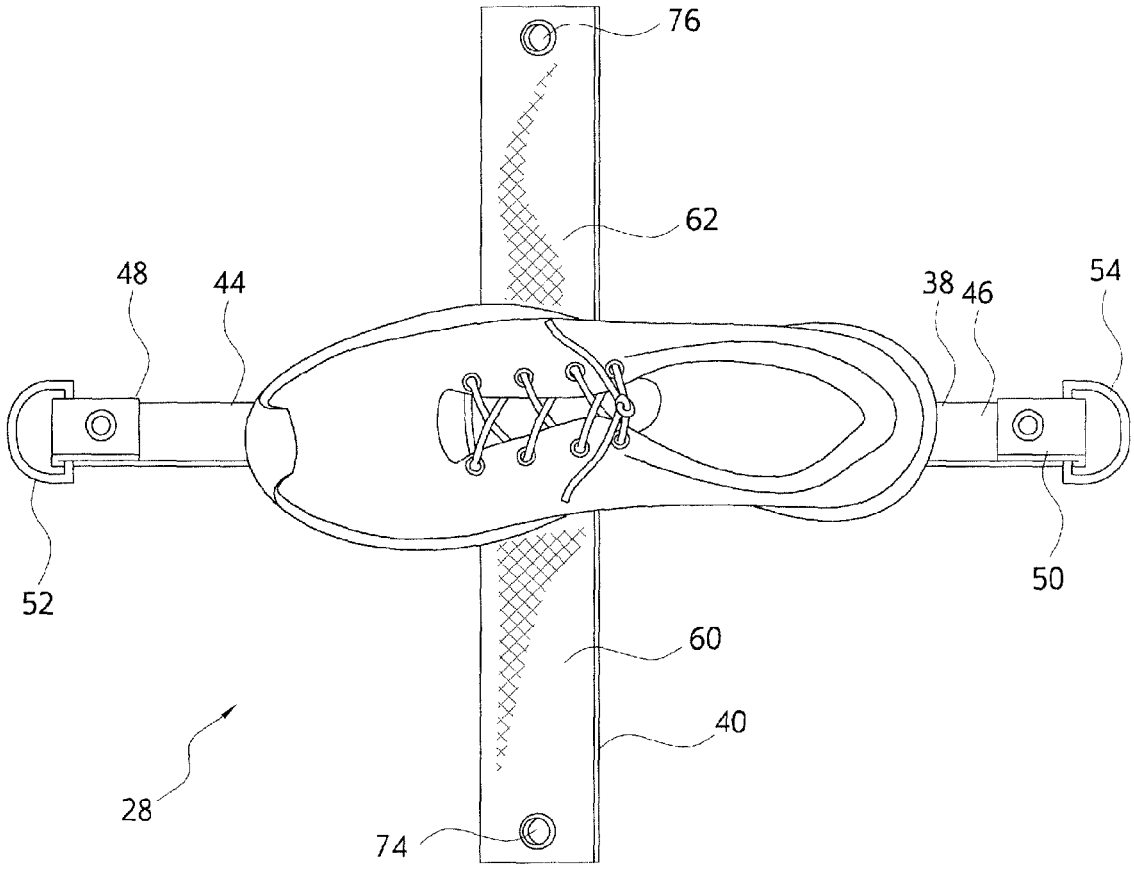
FIG. 6 is a top view of the first foot engaging platform with an athletic shoe central positioned thereon.
Figure 7:
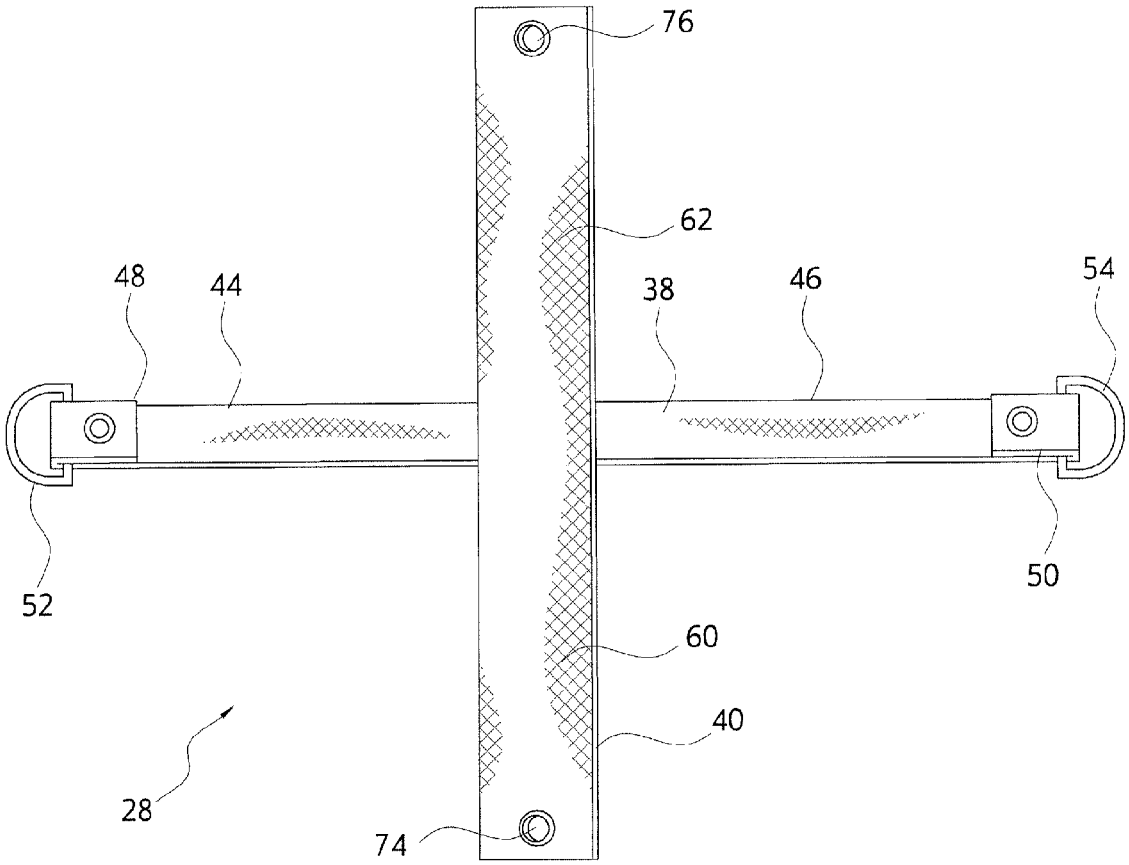
FIG. 7 is a top view of the first foot engaging platform with the athletic shoe removed.
Figure 8:
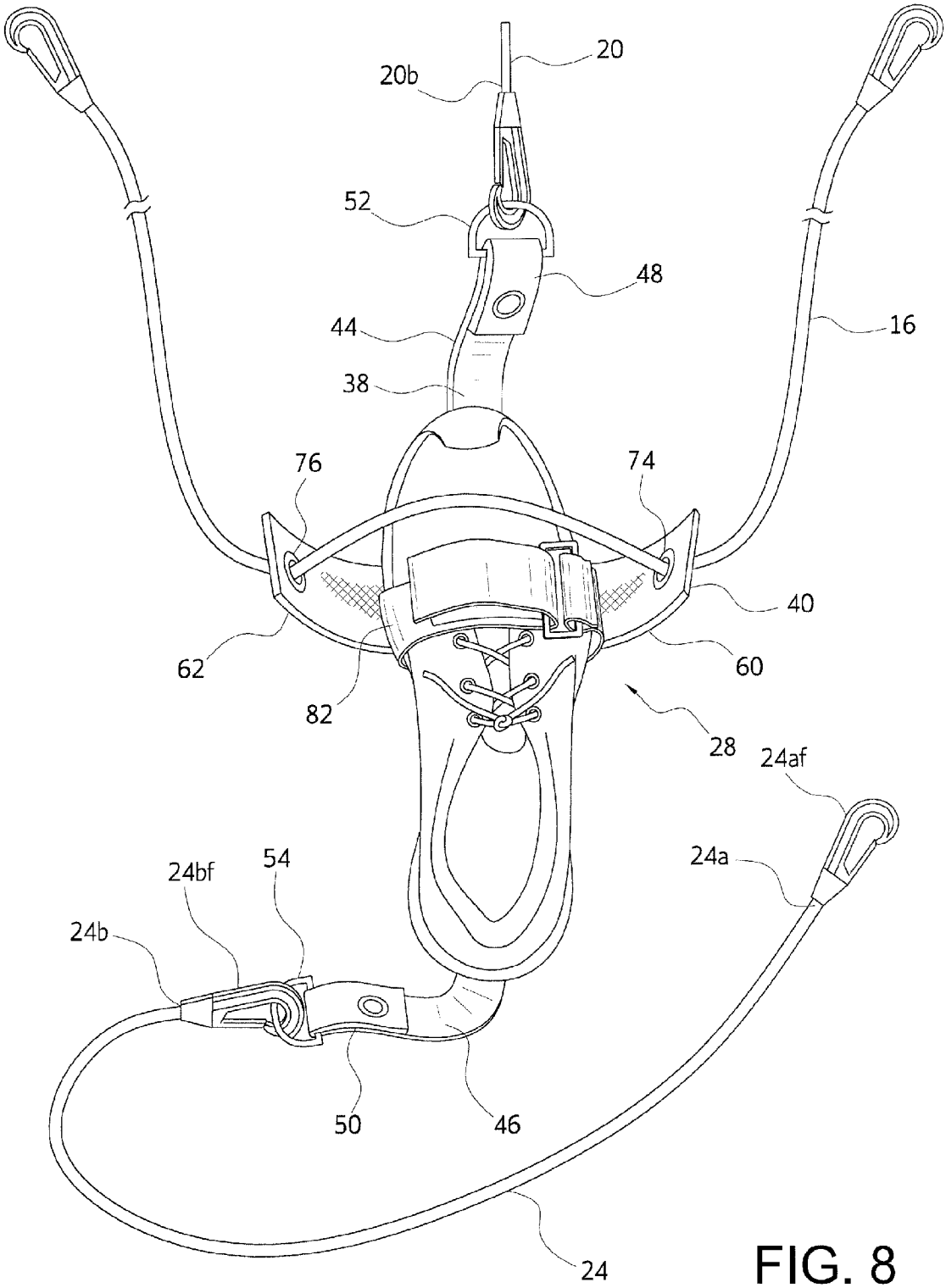
FIG. 8 is a perspective view of the first foot engaging platform with a shoe and resilient straps secured thereto.

The details of the support sleeve 72 and the associated attachment loops 32*e-h* are shown with reference to FIGS. 2 and 3. These attachment loops 32*e-h* are coupled to a support sleeve 72 that is shaped and dimensioned to slide over the belt 12 so that the support sleeve 72, and ultimately the attachment loops 32*e-h*, may be supported from the belt 12 during use. As such, the support sleeve 72 includes an outer wall member 72*a* connected to an inner wall member 72*b* so as to define a passageway 72*c* therebetween. The passageway 72*c* is shaped and dimensioned to receive the belt 12. Each of the attachment loops 32*e-h* is coupled to the support sleeve 72 by an adjustable connection strap 34 extending from the support sleeve 72. As may be appreciated, the use of a support sleeve 72 is needed for frontal support as this is the location where the first and second ends 64, 68 meet for securing the belt 12 about the waist of a user. As such, it would not be practical to position the attachment loops 32*e-h* directly to the belt 12 as the location where the first and second ends 64, 68 overlap in attachment to the waist of the user will vary depending upon the waist size of the user.

Referring now to the first and second foot engaging platforms 28, 30, they are identical and only the first foot engaging platform 28 is described below with reference to FIGS. 1 and 5-8. The first foot engaging platform 28 is shaped and dimensioned to apply pressure to the foot and leg at various angular orientations. With this in mind, the first foot engaging platform 28 includes a long first support member 38 extending along a first axis and a circular second support member 40 extending along a second axis substantially perpendicular to the first axis. The first support member 38 and the second support member 40 are connected where they intersect. The second support member 40 is oriented at a position such that is sits approximately at the forefoot of the user. As such, the second support member 40 is shaped and dimensioned to fit about the forefoot of the user. With this mind, and to ensure a snug fit at the forefoot of a user, the second support member 40 is provided with first and second eyelets 74, 76 on opposite first and second lateral sides 60, 62 thereof allowing the second support member 40 to be wrapped about the forefoot of the user. In particular, and as will be discussed below in greater detail, a resilient strap is run through the first and second eyelets 74, 76 connecting the first and second lateral sides 60, 62 of the second support member 40. When the resilient strap is secured to the belt 12 as discussed herein, the first and second lateral sides 60, 62 of the second support member 40 are pulled together with the forefoot of the user secured in the loop defined by the second support member 40. It is appreciated this configuration allows for the second support member 40 to accommodate various foot sizes. It is appreciated it may be desirable to space the first lateral side 60 from the second lateral side 62 when the resilient strap is pulled drawing the first lateral side 60 toward the second lateral side 62. Where this is desired a rigid spacer cylinder may be positioned over the resilient strap in the area between the first eyelet 74 of the first lateral side 60 and the second eyelet 76 of the second lateral side 62.

In accordance with a preferred embodiment, the second support member 40 bisects the first support member 38 at a position dividing the first support member 38 into a first segment 44 above the second support member 40 and a second segment 46 below the second support member 40 wherein the second segment 46 is approximately 3 times the length of the first segment 44.

The first support member 38 includes a first end 48 and a second end 50, wherein the first end 48 of the first support member 38 is provided with a fastening member, in particular, a fastening eyelet (or loop) 52, shaped and dimensioned for selectively engagement with an end of a resilient cable as discussed below in greater detail. The second end 50 of the first support member 38 is provided with a fastening member, in particular, a fastening eyelet (or loop) 54, shaped and dimensioned for selectively engagement with an end of a resilient cable as discussed below in greater detail. It is appreciated the first and second lateral sides 60, 62 of the second support member 40 are defined to be those sides of the second support member 40 to be located to the left and right of the first support member 38 when the foot engaging platform 28 is secured to the foot of a user.

In order to ensure more secure attachment of the foot engaging platform 28 is provide with a securing strap 82 shaped and dimensioned to wrap about the forefoot of the user. The securing strap 82 is attached the second support member 40 and is oriented to extend parallel to the first support member 38. The securing strap includes hook and loop fasteners 84 at its end so that it may be wrapped and secured about the forefoot of the user.

As briefly mentioned above, a plurality of resilient straps 16, 18, 20, 22, 24, 26 are used to secure the foot engaging platform 28 to the belt 12. As will be appreciated, these resilient straps 16, 18, 20, 22, 24, 26 are specifically selected to work different muscles of the leg and the lengths/strengths of the resilient straps may be varied to achieved different goals. Each of the resilient straps 16, 18, 20, 22, 24, 26 includes a first end 16*a*, 18*a*, 20*a*, 22*a*, 24*a*, 26*a* with a first strap fastening member 16*af*, 18*af*, 20*af*, 22*af*, 24*af*, 26*af* and a second end 16*b*, 18*b*, 20*b*, 22*b*, 24*b*, 26*b* with a second strap fastening member 16*bf*, 18*bf*, 20*bf*, 22*bf*, 24*bf*, 26*bf*. In accordance with a preferred embodiment, the first and second strap fastening members are clips shaped and dimensioned for selective attachment to the attachment loops 32*a-h* of the belt 12 and the fastener eyelets 52, 54, 74, 76 of the first and second foot engaging platforms 28, 30.

In accordance with a preferred embodiment, the training device 10 is minimally provided with first and second central resilient straps 16, 18 for selective attachment to the second support member 40, first and second toe resilient straps 20, 22 for selective attachment to the toe or first end 48 end of the first support member 38 and first and second heel resilient straps 24, 26 for selective attachment to the heel or second end 50 of the first support member 38. These resilient straps may be provided in various lengths and resilient strengths in order to accommodate the needs of various users.

The first and second central resilient straps 16, 18 for selective attachment to the second support member 40 are of a length allowing them to respectively pass through the first and second fastener eyelets 74, 76 of the second support member 40 with the first ends 16*a*, 18*a* of the first and second central resilient straps 16, 18 selectively secured to an attachment loop 32*a-h* (for example, attachment loops 32*b* and 32*h* in accordance with a disclosed embodiment as shown in FIG. 1) on the belt 12 and the second ends 16*b*, 18*b* of the first and second central resilient straps 16, 18 selectively secured to a different attachment loop 32*a-h* (for example, attachment loops 32*e* and 32*c* in accordance with a disclosed embodiment as shown in FIG. 1) on the belt 12.

The first and second toe resilient straps 20, 22 for selective attachment to the toe or first end 48 of the first support member 38 are of a length allowing them to extend between an attachment loop 32*a-h* of the belt 12 and the fastener eyelet 52 at the first ends 48 of the first support members 38 of the first and second foot engaging platforms 28, 30, which are adapted for positioning adjacent the toes of a user. As such, the first ends 20*a*, 22*a* of the first and second toe resilient straps 20, 22 are selectively secured to attachment loops 32*a-h* (for example, attachment loops 32*f* and 32*g* in accordance with a disclosed embodiment as shown in FIG. 1) of the belt 12 while the second ends 20*b*, 22*b* of the first and second toe resilient straps 20, 22 are selectively secured to the fastener eyelets 52 at the first ends 48 of the first support members 38 of the first and second foot engaging platforms 28, 30.

The first and second heel resilient straps 24, 26 for selective attachment to the heel or second end 50 of the first support member 38 are of a length allowing them to extend between attachment loops 32*a-h* of the belt 12 and the fastening eyelets 54 at the second ends 50 of the first support members 38 of the first and second foot engaging platforms 28, 30, which are adapted for positioning adjacent the heel of a user. As such, the first ends 24*a*, 26*a* of the first and second heel resilient straps 24, 26 are selectively secured to attachment loops 32*a-h* (for example, attachment loops 32*a* and 32*d* in accordance with a disclosed embodiment as shown in FIG. 1) of the belt 12 while the second ends 24*b*, 26*b* of the first and second heel resilient straps 24, 26 are selectively secured to the fastener eyelets 54 at the second ends 50 of the first support members 38 of the first and second foot engaging platforms 28, 30.

In use, the belt 12 is positioned about the waist of a user and the first and second foot engaging platforms 28, 30 are respectively secured to the user's left and right feet. The resilient straps 16, 18, 20, 22, 24, 26 are then coupled between the first and second foot engaging platforms 28, 30 and the belt 12 with the resilient straps 16, 18, 20, 22, 24, 26 oriented in a manner defined by the exercise to be performed. That is, the ends of the resilient straps 16, 18, 20, 22, 24, 26 may be secured to different attachment loops 32*a-h* of the belt 12 and different fastener eyelets 52, 54, 74, 76 of the first and second foot engaging platforms 28, 30 depending upon the exercise being performed and the muscles the user wishes to work. Once the device is properly attached to the user's body, the user may exercise while the resilient straps apply resistance to the motion of his or her legs. The constant resistance exercises the muscles in the user's legs and core, and ultimately increases the strength of the user's legs and core.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A training device, comprising:

a belt for attachment about a waist of a user, the belt including a first end and a second end, as well as a plurality of attachment loops secured on the belt adapted for positioning along a back of a user as he or she exercises and adapted for positioning along a front of a user as he or she exercises at various locations about a circumference of the belt; and six resilient straps selectively positioned between the plurality of attachment loops of the belt and a first foot engaging platform and a second foot engaging platform, the first foot engaging platform includes a long first support member extending along a first axis and a second support member extending along a second axis substantially perpendicular to the first axis, the second support member being shaped and dimensioned for coupling to at least one of the six resilient straps, and the first support member includes a first end and a second end, the first end of the first support member being provided with a fastening member shaped and dimensioned for selective engagement with an end of at least one of the six resilient straps and the second end of the first support member being provided with a fastening member shaped and dimensioned for selective engagement with an end of at least one of the six resilient straps.

2. The training device according to claim 1, wherein the first end and the second end of the belt respectively include mating hook and loop material to facilitate secure attachment of the belt about the waist of the user.

3. The training device according to claim 1, wherein adjustable connection straps respectively couple the plurality of attachment loops to the belt.

4. The training device according to claim 1, wherein the plurality of attachment loops includes four attachment loops secured on the belt and adapted for positioning along a back of a user as he or she exercises and four attachment loops secured to the belt and adapted for positioning along a front of a user as he or she exercises.

5. The training device according to claim 4, wherein the four attachment loops adapted for positioning along the back of the user are fixedly secured to the belt at a position between the first end of the belt and the second end of the belt.

6. The training device according to claim 5, wherein the four attachment loops adapted for positioning along a front of a user as he or she exercises are secured to a support sleeve which is slid over the belt such that it is adapted for alignment with a front of an individual using the training device.

7. The training device according to claim 4, wherein the four attachment loops adapted for positioning along a front of a user as he or she exercises are secured to a support sleeve which is slid over the belt at a position between the first end of the belt and the second end of the belt such that it is adapted for alignment with a front of an individual using the training device.

8. The training device according to claim 7, wherein the support sleeve includes an outer wall member connected to an inner wall member so as to define a passageway therebetween, the passageway being shaped and dimensioned to receive the belt, and wherein each of the four attachment loops adapted for positioning along a front of a user is coupled to the support sleeve by an adjustable connection strap extending from the support sleeve.

9. The training device according to claim 1, wherein the second support member is oriented at a position such that it is adapted to sit approximately at a forefoot of the user, and the second support member includes first and second eyelets on opposite first and second lateral sides of the second support member thereof allowing the second support member to be wrapped about the forefoot of the user.

10. The training device according to claim 9, wherein the second support member bisects the first support member at a position dividing the first support member into a first segment above the second support member and a second segment below the second support member.

11. The training device according to claim 10, wherein the second segment is approximately 3 times a length of the first segment.

12. The training device according to claim 1, wherein the second foot engaging platform includes a long first support member extending along a first axis and a second support member extending along a second axis substantially perpendicular to the first axis, the second support member of the second foot engaging platform being oriented at a position such that it is adapted to sit approximately at a forefoot of the user.

13. The training device according to claim 12, wherein the second support member of the second foot engaging platform includes first and second eyelets on opposite first and second lateral sides of the second support member of the second foot engaging platform thereof allowing the second support member of the second foot engaging platform to be wrapped about the forefoot of the user, the first and second eyelets being shaped and dimensioned for coupling to at least one of the six resilient straps.

14. The training device according to claim 13, wherein the first support member of the second foot engaging platform includes a first end and a second end, the first end of the first support member of the second foot engaging platform being provided with a fastening member shaped and dimensioned for selective engagement with an end of at least one of the six resilient straps and the second end of the first support member of the second foot engaging platform being provided with a fastening member shaped and dimensioned for selective engagement with an end of at least one of the six resilient strap.

15. A training device, comprising:

a belt for attachment about a waist of a user, the belt including a first end and a second end, as well as a plurality of attachment loops secured on the belt adapted for positioning along a back of a user as he or she exercises and adapted for positioning along a front of a user as he or she exercises at various locations about a circumference of the belt; and a plurality of resilient straps selectively positioned between the plurality of attachment loops of the belt and a first foot engaging platform and a second foot engaging platform;

the first foot engaging platform includes a long first support member extending along a first axis and a second support member extending along a second axis substantially perpendicular to the first axis, the second support member of the first foot engaging platform is selectively coupled with a first resilient strap of the plurality of resilient straps, and the first support member of the first foot engaging platform includes a first end and a second end, the first end of the first support member of the first foot engaging platform is selectively coupled with a second resilient strap of the plurality of resilient straps and the second end of the first support member of the first foot engaging platform is selectively coupled with a third resilient strap of the plurality of resilient straps; and the second foot engaging platform includes a long first support member extending along a first axis and a second support member extending along a second axis substantially perpendicular to the first axis, the second support member of the second foot engaging platform is selectively coupled with a fourth resilient strap of the plurality of resilient straps, and the first support member of the second foot engaging platform includes a first end and a second end, the first end of the first support member of the second foot engaging platform is selectively coupled with a fifth resilient strap of the plurality of resilient straps and the second end of the first support member of the second foot engaging platform is selectively coupled with a sixth resilient strap of the plurality of resilient straps.

* * * * *